US006576040B2

(12) United States Patent
Magnet et al.

(10) Patent No.: US 6,576,040 B2
(45) Date of Patent: Jun. 10, 2003

(54) PROCESS AND PLANT WITH OXYGEN-ENRICHED AIR FEED FOR A NON-FERROUS METAL PRODUCTION UNIT

(75) Inventors: Didier Magnet, Vincennes (FR); Norbert Rieth, Paris (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/953,944

(22) Filed: Sep. 18, 2001

(65) Prior Publication Data

US 2002/0033566 A1 Mar. 21, 2002

(30) Foreign Application Priority Data

Sep. 18, 2000 (FR) ..... 00 11878

(51) Int. Cl.[7] ..... C22B 15/06

(52) U.S. Cl. ..... 75/585; 266/187; 266/160; 75/645

(58) Field of Search ..... 266/142, 160, 266/187; 75/643, 644, 645, 585

(56) References Cited

U.S. PATENT DOCUMENTS

| | | | | |
|---|---|---|---|---|
| 5,194,213 A | * | 3/1993 | Diaz et al. | 266/142 |
| 5,291,737 A | | 3/1994 | Camberlein et al. | |
| 5,882,373 A | | 3/1999 | Guillard et al. | |
| 6,062,043 A | * | 5/2000 | Magnet et al. | 75/466 |
| RE37,014 E | * | 1/2001 | Guillard et al. | 75/466 |

FOREIGN PATENT DOCUMENTS

| | | |
|---|---|---|
| FR | 2 774 157 | 7/1999 |
| JP | 11 335751 A | 12/1999 |
| SU | 1 296 616 A | 8/1987 |

* cited by examiner

*Primary Examiner*—Melvyn Andrews
(74) *Attorney, Agent, or Firm*—Young & Thompson

(57) ABSTRACT

All of the air is compressed in a single compressor, which feeds a smelter for smelting ore, a converter for converting matte coming from the smelter and an air separation unit which delivers two oxygen streams for enriching the air. A buffer tank is used to deliver a variable flow of enriched air to the converter.

14 Claims, 2 Drawing Sheets

PROCESS AND PLANT WITH OXYGEN-ENRICHED AIR FEED FOR A NON-FERROUS METAL PRODUCTION UNIT

FIELD OF THE INVENTION

The present invention relates to a process for feeding oxygen-enriched air into a non-ferrous metal production unit comprising, on the one hand, a smelter for smelting an ore concentrate of the said metal, fed by continuously injecting oxygen-enriched air and, on the other hand, a converter for converting the matte coming from the smelter, fed by injecting oxygen-enriched air with a variable flow rate, and to a plant for implementing this process. The invention applies in particular to the production of copper.

BACKGROUND OF THE INVENTION

The pressures mentioned below are absolute pressures.

Copper production units conventionally consist of a smelter operating continuously, such as a flash furnace, a Noranda furnace or a Teniente furnace, and of a converter operating batchwise, such as a Pierce converter or a Hoboken converter.

The raw material, composed of copper ore concentrate, is charged into the smelter, in which it becomes enriched with copper. A copper-rich mixture called "matte", containing by weight approximately 60 to 70% copper, is then obtained. This matte is then further enriched with copper in the converter and is converted into what is called "blister" copper containing approximately 99% copper.

In order for the smelting and the conversion to take place correctly, the smelter and the converter are fed with streams of oxygen-enriched air. The smelter consumes a constant stream of oxygen-enriched air. In contrast, the converter consumes a variable stream of oxygen-enriched air. Moreover, this stream may be close to zero when, the conversion into blister copper having been completed, the ladle of the converter is emptied in order to recover the blister copper and thus be able to start a new copper production cycle. Typically, a copper production cycle lasts approximately two hours, distributed as follows:

- oxygen-enriched air is injected into the converter for approximately one hour;
- the injection is stopped, the slag floating on the surface of the liquid copper is removed, the ladle is drained in order to recover the copper, after which the ladle is recharged with matte and a new cycle is started.

While the ladle is being drained, a gentle stream of oxygen-enriched air is maintained in order to maintain the flame of the converter burners. The degree of oxygen enrichment of the air depends on the composition of the raw material and on the expected production. As a general rule, the stream of air feeding the smelter is enriched with up to 28% oxygen and the stream of air feeding the converter is enriched with 50 to 60% oxygen.

Conventionally, the smelter and converter each have an air blower, the stream of air from which is enriched by injecting oxygen produced by a plant independent of the two air blowers.

Since the consumption of oxygen-enriched air by the smelter is constant, the air blower connected to the smelter permanently produces an air stream corresponding to the maximum flow rate of the copper production cycle. In contrast, since the consumption of oxygen-enriched air by the converter is variable, the difference between the output of air produced by the blower connected to the converter, which operates continuously, and that consumed by this converter is generally vented to atmosphere.

The oxygen production plant consists of an air compressor and an air separation unit which is capable of delivering a variable flow of oxygen so as to enrich the air stream of the blower for the smelter with a constant oxygen stream and to enrich the air stream for the converter with a variable oxygen stream.

The term "compressor" is understood here to mean an actual compressor or several compressors mounted in parallel and having a common delivery.

This process for producing oxygen-enriched air by a plant comprising two independent air blowers connected to an oxygen production unit has various drawbacks, such as large overall size, considerable energy consumption and not insignificant loss of energy due to the air delivered by one of the blower being vented to atmosphere.

SUMMARY OF THE INVENTION

It is therefore an object of the invention to provide a process and a plant for feeding oxygen-enriched air into a non-ferrous metal production unit, which is smaller in overall size and which allows the energy expenditure to be substantially reduced.

The subject of the invention is therefore a process for feeding oxygen-enriched air into a non-ferrous metal production unit comprising, on the one hand, a smelter for smelting the concentrate of the said metal, fed by continuously injecting oxygen-enriched air and, on the other hand, a converter for converting the matte coming from the smelter, fed by injecting oxygen-enriched air with a variable flow rate, characterized in that:

- all of the air is compressed in a single compressor capable of feeding the smelter and the converter;
- some of this compressed air is treated in an air separation unit in order to obtain two oxygen streams which are injected into the compressed air intended for feeding the smelter and the converter, respectively; and
- the compressed air or oxygen-enriched compressed air intended for the converter is stored in a buffer tank when the consumption of oxygen-enriched air by the converter is below a predetermined threshold and compressed air or oxygen-enriched compressed air is removed from the buffer tank when the consumption of oxygen-enriched air by the converter is above the said threshold.

According to other features of this process:

- the smelter is fed by mixing air compressed by the first compression level of the compressor with oxygen produced by the air separation unit substantially at the same pressure;
- the air separation unit is fed with compressed air by a compression level of the compressor located behind the first compression level of this compressor;
- the converter is fed by mixing air compressed by the compressor to a pressure above the feed pressure of this converter with oxygen produced by the air separation unit substantially at the same pressure, by storing the oxygen-enriched air in the said buffer tank when the consumption of oxygen-enriched air by the converter is below the said threshold and by removing oxygen-enriched air from this buffer tank through an expansion device when the consumption of oxygen-enriched air by the converter is above the said threshold;
- air compressed by the final stage of the compressor to a pressure above the feed pressure of the converter is stored in the said buffer tank when the consumption of oxygen-enriched air by this converter is below the said threshold and the converter is fed by mixing air stored in the buffer tank and/or air compressed by the final stage of the compressor, both air streams being removed through an expansion device, with oxygen produced by the air separation unit at a variable rate and at a pressure substantially equal to the feed pressure of the converter;

the air intended for the converter is compressed by the final stage of the compressor.

The subject of the invention is also a plant for implementing the process defined above. This plant is characterized in that it comprises:

an air separation unit designed to deliver oxygen to the smelter and the converter;

a single air compressor, the delivery side of which is connected to the smelter, to the air separation unit and to the converter via first, second and third lines respectively; and a buffer tank connected to the said third line.

According to other features of this plant:

the buffer tank is also connected, on the one hand, to an oxygen output line from the separation unit intended for the converter and, on the other hand, to this converter via an expansion device. The buffer tank is also connected to the converter via an expansion device and an oxygen output line from the separation unit intended for the converter runs into the line which connects this expansion device to the converter.

the air separation unit comprises two oxygen production circuits, one feeding the smelter and the other feeding the converter;

the oxygen production circuit feeding the converter is provided with means for adjusting the oxygen flow rate;

the air separation unit is a double-column air distillation unit which includes a swing system so as to produce a variable stream of oxygen by distillation of a constant air input;

the air compressor comprises at least two compression levels, the delivery of the first level being connected to the said first line and the delivery of the following level or levels being connected to the said second and third lines;

the compressor has three compression levels, the deliveries of which are connected to the said first, second and third lines, respectively.

As will have been understood, the invention essentially consists in combining the air production with the oxygen production so that oxygen-enriched air for feeding the smelter and the converter of a non-ferrous metal production unit is produced more economically.

BRIEF DESCRIPTION OF THE DRAWINGS

Illustrative examples of the invention will now be described with reference to the appended drawings in which.

DETAILED DESCRIPTION OF THE INVENTION

Figure 1:
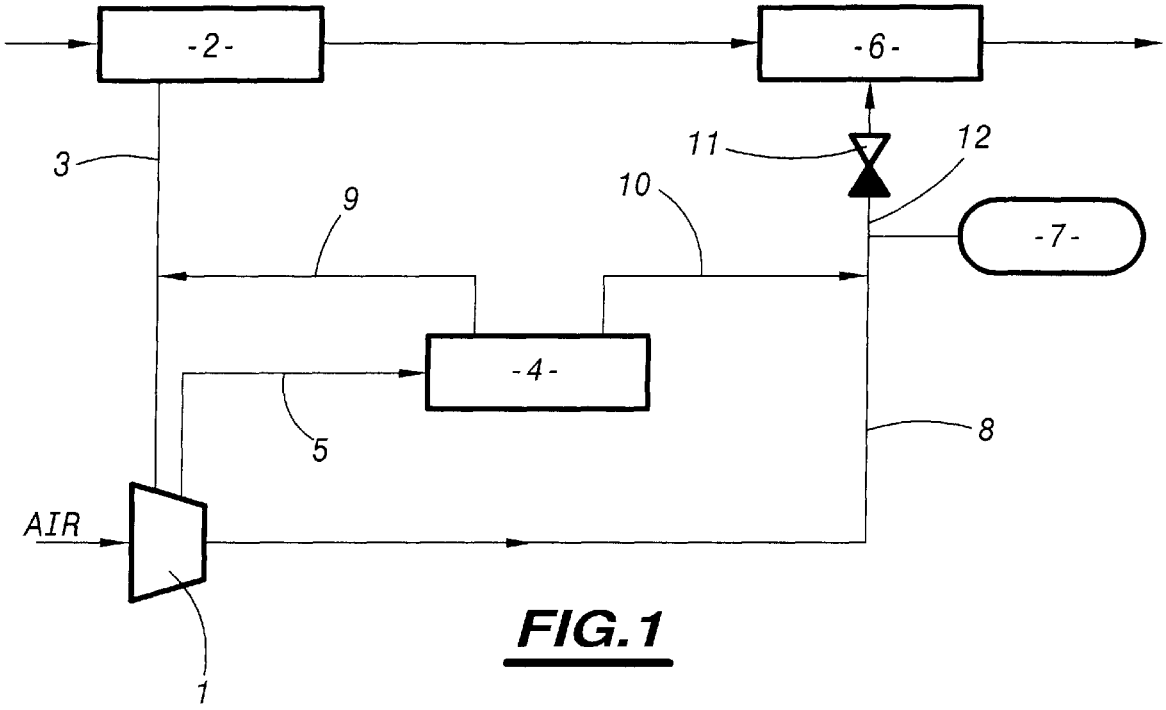
FIG. 1 shows schematically a plant for producing oxygen-enriched air feeding a copper smelter and a copper converter.

FIG. 1 shows a copper production plant which comprises a single air compressor 1 having 3 compression levels (i.e. for example 4 or 5 stages) feeding compressed air respectively into, firstly, a smelter 2 via a first line 3, secondly an air separation unit 4 via a second line 5 and, finally, a converter 6 or a buffer tank 7 via a third line 8. The air separation unit 4 producing the oxygen has two separate output circuits delivering oxygen at different pressures, one 9 feeding the smelter 2, the other 10 feeding the converter 6. Each circuit 9, 10 is a circuit with a constant flow rate.

The buffer tank 7 is capable of storing the compressed air and the oxygen of the second circuit 10 when the consumption of oxygen-enriched air by the converter 6 is low, that is to say below a predetermined threshold. An expansion valve 11, consisting of a downstream pressure regulator, is placed in a line 12 which connects the converter to the buffer tank 7, in order for the stream of oxygen-enriched air to flow in the circuit 12 and to be injected into the converter 6 when the consumption by this unit 6 is high, that is to say above the said threshold.

The plant in FIG. 2 differs from the previous one by the fact that the air separation unit 4 here is equipped with a system called a "swing" system, described later, allowing a variable flow of oxygen to be delivered to the converter 6 while the unit 4 handles a constant flow of air. In addition, the expansion valve 11 is placed between the tank 7 and the point 13 where the oxygen produced by the circuit 10 meets the line 12 for feeding enriched air into the converter 6.

In operation, in the case of FIG. 1, all of the air needed to operate the copper production unit is compressed in the compressor 1.

Some of this air, extracted from the delivery of the first compression level of the compressor 1, at a constant pressure of between 1.2 and 1.7 bar, is injected at a constant flow rate into the smelter 2 after having been enriched by an oxygen stream 9, at a pressure substantially equal to that of the air stream produced at a constant flow rate by the air separation unit 4.

Some of the air coming from one of the following compression levels (for example, the second compression level) of the compressor 1 passes through the air separation unit 4. The latter delivers, on the one hand, an oxygen stream 9 at a pressure of 1.2 to 1.7 bar feeding the smelter 2, and, on the other hand, a second oxygen stream 10 at a pressure of 5 to 10 bar intended for the converter 6. The remainder 8 of the compressed air is extracted from the final stage of the compressor 1 at a pressure of approximately 5 to 10 bar and is joined to the aforementioned oxygen stream 10. The enriched air thus obtained feeds either the buffer tank 7, when the consumption of oxygen-enriched air is low, or the converter 6 via the expansion valve 11, when the consumption of enriched air is high.

Figure 2:
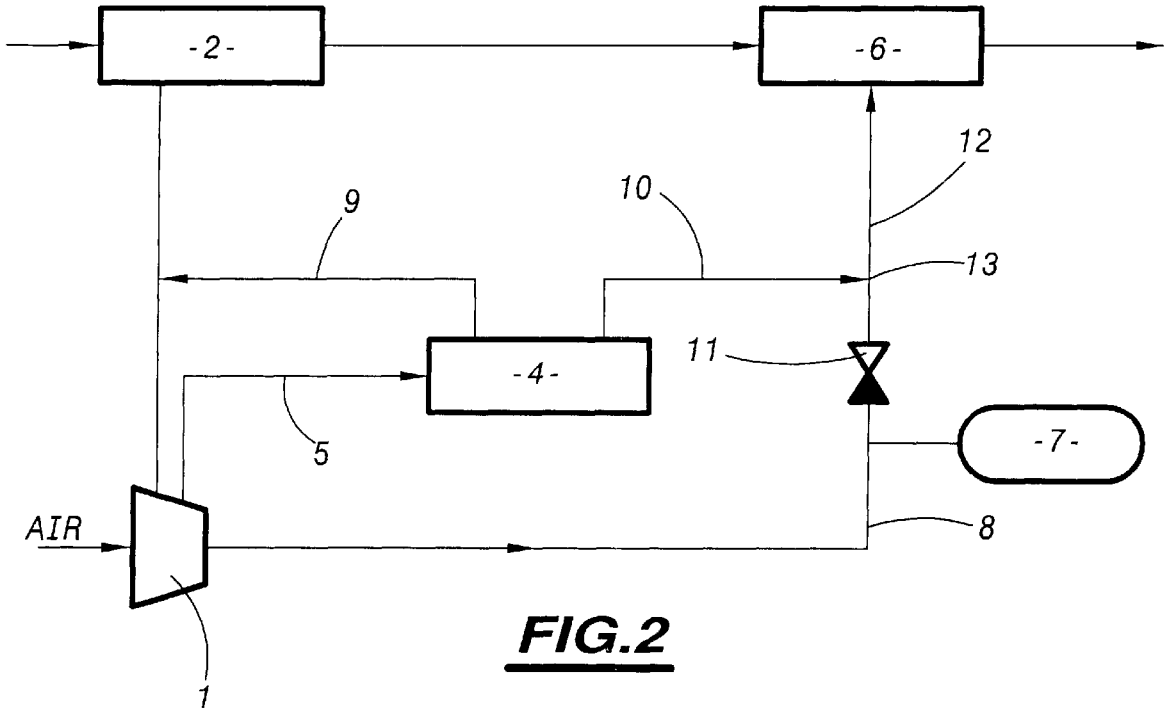
FIG. 2 shows an alternative embodiment of the plant in FIG. 1.

According to the variant in FIG. 2, the air separation unit 4 delivers a first oxygen stream 9, at a constant flow rate and at a pressure of 1.2 to 1.7 bar, which feeds the smelter 2. The air separation unit also delivers a second oxygen stream 10 at a pressure of approximately 1.5 bar, which feeds the converter 6, a swing being provided so as to deliver the oxygen at a variable flow rate depending on the consumption of enriched air by the converter 6.

The remainder 8 of the compressed air is extracted from the final stage of the compressor at a pressure of approximately 5 to 10 bar. When the consumption of oxygen-enriched air by the converter 6 is low, this air is partly stored in the buffer tank 7. At any instant, a flow of air equal to the difference between the flow of enriched air demanded by the converter 6 and the flow of oxygen 10 passes through the expansion valve.

To meet the abovementioned saving criteria the air produced by the air compressor and feeding the air separation unit and the tank 7 is at a pressure corresponding to an optimum value from the economic and energy standpoints between the energy expended for compressing the air and the cost corresponding to the investment in the buffer tank allowing the converter to be fed with enriched air in a discontinuous manner.

Thus, the pressure of the air produced by the air compressor for feeding the air separation unit is preferably from 5 to 6 bar and the pressure of the air produced by the air compressor for feeding the gas tank is preferably from 5 to 10 bar.

Figure 3:
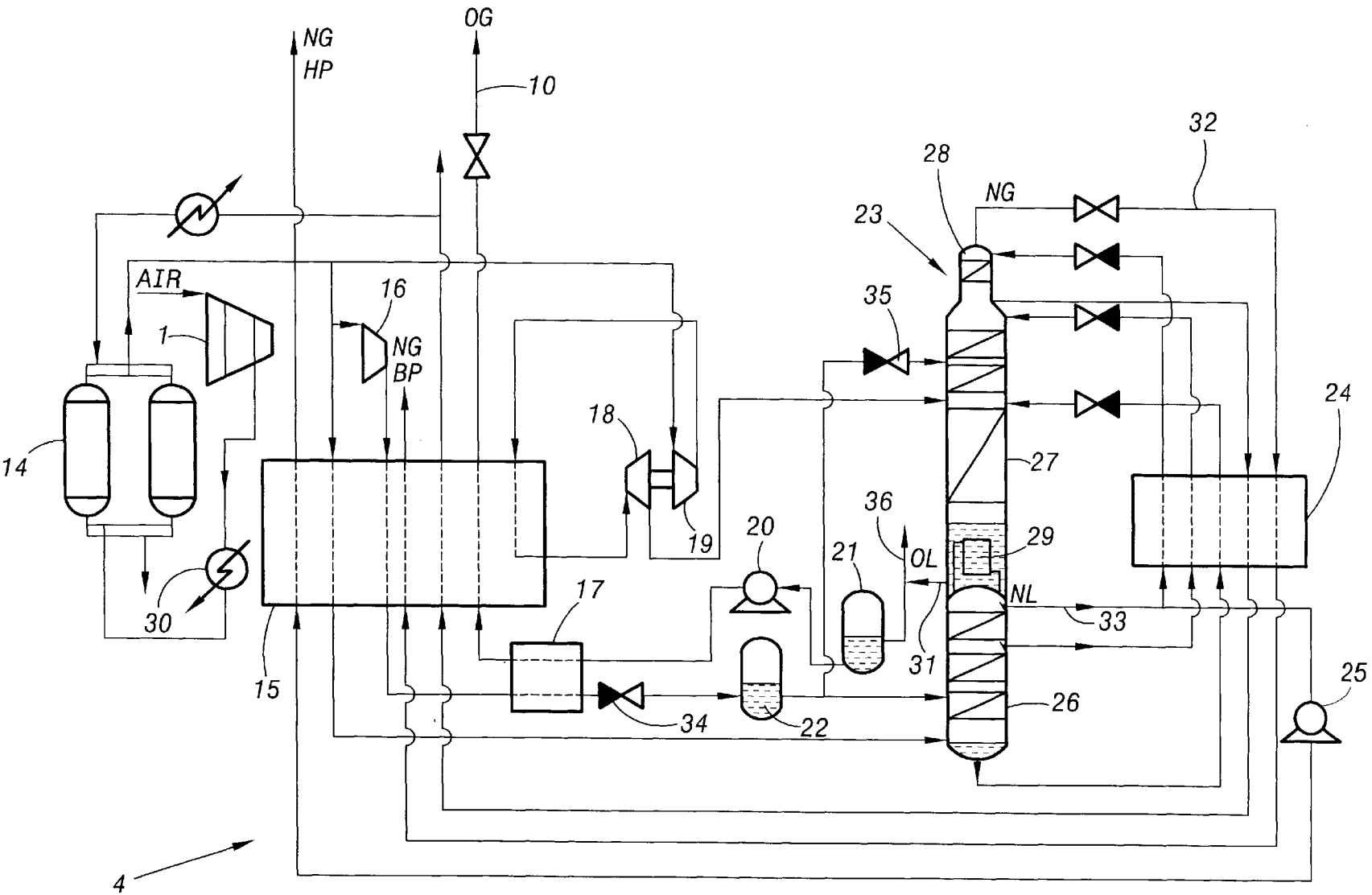
FIG. 3 shows an air separation unit intended for the plant of FIG. 2.

The air separation unit 4 shown in FIG. 3, of the conventional "swing" type, is intended to deliver a variable flow of oxygen to the line 10 in FIG. 2. It basically comprises the air compressor 1 with three compression levels, an apparatus 14 for drying and decarbonizing the air by adsorption, a main heat exchange line 15, an air supercharger 16, an auxiliary heat exchanger 17, a turbocompressor set comprising a turbine 18 coupled to a compressor 19, a variable-flow liquid oxygen pump 20, a liquid oxygen buffer tank 21, a liquid air buffer 22, a double air distillation column 23, a subcooler 24 and a liquid nitrogen pump 25. The double column 23 is of the minaret type and comprises a medium-pressure column 26 surmounted by a low-pressure column 27, the latter being extended upward by a short distillation section or minaret 28 of smaller diameter. A main reboiler-condenser 29 brings the overhead vapour (almost pure nitrogen) of the column 26 into indirect heat exchange relationships with the liquid (liquid oxygen) in the bottom of the column 27.

In operation, a constant air flow coming from the second compression level of the compressor 1, brought back to near ambient temperature at 30, purified at 14 and then cooled down to near its dew point at 15, is injected into the bottom of the column 26.

According to the conventional double-column distillation process, the double column 23 produces, with constant flow rates, liquid oxygen 31 from the bottom of the column 27, low-pressure gaseous nitrogen 32 from the top of the minaret 28 and medium-pressure liquid oxygen 33 from the top of the medium-pressure column 26.

The liquid oxygen withdrawn from the low-pressure column is stored in the buffer tank 21 and, consequently, is compressed to the pressure of the circuit 10 by the pump 20 and then vapourized when flowing as a countercurrent through a stream of air with a constant flow rate supercharged at 16. The air thus liquefied is, after expansion to the medium pressure in an expansion valve 34, stored in the buffer tank 22 before being partially introduced in the liquid state into the lower part of the column 26 and, for the remainder, expanded to the low pressure in an expansion valve 35 and introduced at an intermediate level of the column 27.

Conventionally, when the flow of gaseous oxygen needed in the circuit 10 is less than 21% of the flow of distilled air, the pump 20 is slowed down correspondingly, and the liquid oxygen level rises in the tank 21. At the same time, since a lesser flow of air is liquefied, the liquid air level falls in the tank 22. The phenomena reverse should the oxygen flow in 10 increase to above 21% of the flow of distilled air.

Moreover, the unit 4 produces a constant flow of gaseous oxygen for the circuit 9, for example from another line 36 for withdrawing liquid oxygen from the column 27, then vapourization/warming in 15 and possibly compression of the resulting gaseous oxygen.

The unit 4 also produces a stream of low-pressure gaseous nitrogen coming from the minaret 28 and warmed in 24 and then in 15, together with a stream of high-pressure gaseous nitrogen obtained by medium-pressure liquid nitrogen pumping in 25 followed by vapourization/warming in 15. These two nitrogen streams are used for inerting and/or conveying in the copper production plant.

The turbocompressor set 18,19, which operates by supercharging and expanding a portion of the incoming air, serves to keep the unit 4 cold.

An air separation unit like that in FIG. 3 makes it possible to obtain a rate of variation of the oxygen output produced in 10 which is typically of the order of 5% per minute.

The invention may also be applied to the production of non-ferrous metals other than copper, such as nickel.

What is claimed is:

1. A process for producing a non-ferrous metal comprising the steps of:

smelting an ore concentrate of said metal in a smelter to form a matte including continuously injecting oxygen-enriched air into the smelter;

transferring the matte to a converter;

converting the matte in the converter including injecting oxygen-enriched air with a variable flow rate into the converter;

compressing all of the air in a single compressor prior to injection into the smelter and the converter, the compressor having a first compression level, a seond compression level and a third compression level;

transferring some of the compressed air from the compressor to an air separation unit;

treating the compressed air in the air separation unit to obtain two oxygen streams which are injected into the compressed air injected into the smelter and the converter, respectively; and storing the compressed air or oxygen-enriched compressed air to be injected into the converter in a buffer tank when consumption of oxygen-enriched air by the converter is below a predetermined threshold and removing the compressed air or oxygen-enriched compressed air from the buffer tank when consumption of oxygen-enriched air by the converter is above said threshold.

2. The process according to claim 1, wherein the smelter is fed by mixing air compressed by the first compression level of the compressor with oxygen produced by the air separation unit substantially at the same pressure.

3. The process according to claim 1, wherein the air separation unit is fed with compressed air by the second compression level of the compressor.

4. The process according to claim 1, wherein the converter is fed by mixing air compressed by the compressor to a pressure above a feed pressure of the converter with oxygen produced by the air separation unit substantially at the same pressure, by storing the oxygen-enriched air in said buffer tank when the consumption of oxygen-enriched air by the converter is below said threshold and by removing oxygen-enriched air from the buffer tank through an expansion device when the consumption of oxygen-enriched air by the converter is above said threshold.

5. The process according to claim 1, wherein air compressed by the third compression level of the compressor to a pressure above a feed pressure of the converter is stored in said buffer tank when the consumption of oxygen-enriched air by the converter is below said threshold and the converter is fed by mixing air stored in the buffer tank and/or air compressed by the third compression level of the compressor, both air streams being removed through an expansion device, with oxygen produced by the air separation unit at a variable flow rate and at a pressure substantially equal to the feed pressure of the converter.

6. The process according to claim 1, wherein the air for the converter is compressed by the third compression level of the compressor.

7. A plant for producing a non-ferrous metal comprising a smelter for smelting an ore concentrate of a non-ferrous metal to form a matte, the smelter comprising an inlet for receiving a continuous flow of oxygen-enriched air;

a converter for receiving a matte from the smelter and comprising an inlet for receiving oxygen-enriched air at a variable flow rate;

an air separation unit comprising outlets connected to the smelter and the converter for delivering oxygen to the smelter and the converter;

a single air compressor comprising first, second and third lines and connected via the first line to deliver compressed air to the smelter, connected via the second line to deliver compressed air to the air separation unit and connected via the third line to deliver compressed air to the converter; and a buffer tank connected to the third line of the single air compressor.

8. The plant according to claim 7, further comprising an expansion device connecting the outlet from the separation unit to the converter and the buffer tank to the converter.

9. The plant according to claim 7, further comprising an expansion device connecting the buffer tank to the converter and is positioned before a line connecting the outlet from the air separation unit to the converter.

10. The plant according to claim 7, wherein the air separation unit comprises two oxygen production circuits, one of the circuits feeding the smelter and the other circuit feeding the converter.

11. The plant according to claim 10, further comprising means for adjusting the oxygen flow rate in the oxygen production circuit feeding the converter.

12. The plant according to claim 11, wherein the air separation unit comprises a double-column air distillation unit which includes a swing system to produce a variable stream of oxygen by distillation of a constant air input.

13. The plant according to claim 7, wherein the air compressor comprises at least two compression levels, the delivery of the first compression level being connected to said first line and the delivery of the second compression level or levels being connected to said second and third lines.

14. The plant according to claim 13, wherein the compressor has three compression levels, the deliveries of which are connected to said first, second and third lines, respectively.

* * * * *